United States Patent [19]

Grihangne

[11] 3,952,679

[45] Apr. 27, 1976

[54] FLEXIBLE MARINE TRANSPORT TANK

[75] Inventor: André Grihangne, Paris, France

[73] Assignee: Ste Superflexit, Courbevoie, France

[22] Filed: Nov. 29, 1973

[21] Appl. No.: 420,315

[30] Foreign Application Priority Data

Dec. 12, 1972 France ..... 72.44227

[52] U.S. Cl. ..... 114/74 T

[51] Int. Cl.² ..... B63B 25/14

[58] Field of Search ..... 114/.5 T, 74 T, 74 R, 114/235 A, 235 B, .5 F; 9/2 A

[56] References Cited

UNITED STATES PATENTS

| | | | |
|---|---|---|---|
| 2,346,505 | 4/1944 | Preuss | 114/74 R |
| 2,371,404 | 3/1945 | Mumford | 114/.5 T |
| 2,391,926 | 1/1946 | Scott | 114/74 T |
| 2,720,082 | 10/1955 | Brandon | 114/.5 T |
| 3,067,712 | 12/1962 | Doerpinghaus | 114/74 T |

FOREIGN PATENTS OR APPLICATIONS

| | | | |
|---|---|---|---|
| 1,037,900 | 5/1953 | France | 114/74 T |
| 173,496 | 11/1960 | Sweden | 114/74 T |
| 1,210,934 | 10/1959 | France | 114/74 T |

*Primary Examiner*—Trygve M. Blix
*Assistant Examiner*—Stuart M. Goldstein
*Attorney, Agent, or Firm*—Stevens, Davis, Miller & Mosher

[57] ABSTRACT

A flexible floating tank for conveying liquids comprising at least two elongated flexible elements of revolution joined side by side by a flexible linking harness and provided with inflating gas for maintaining their geometric shape by internal pressurization during various stages of use. The elements are provided with oblique conical end portions and are internally divided by bulkheads. Each element may have a sump which forms a stabilizing keel and also facilitates emptying through a dip pipe while internal pressurization is maintained through a separate duct.

12 Claims, 8 Drawing Figures

5a
16
10
15
8
5
21a
21
39a
19a
19
39
9a
9
2
III
III
1a
1
4a
4
12a
11
12
13a
13
14

42
45a
44
43
41
45

24
25
40
17
18
10
15
46
16
5
21
19
22
23
39
9
1
20
6
4
7

FLEXIBLE MARINE TRANSPORT TANK

The present invention relates to a flexible marine transport tank.

It is known to use for the transport of liquids, especially oil and fuels, flexible tanks consisting of a single element of revolution. These tanks have not possessed the stability and navigability characteristics desirable for increasing their employment.

Also known are marine transport devices which comprise a plurality of flexible containers connected by elastic members and which are held immersed by means of a ballast system. Furthermore, devices are known which comprise a plurality of flexible containers for transporting liquids and which are connected fore and aft by a rigid body of hydrodynamic shape. However, because these devices are immersed or connected by rigid elements they do not permit satisfactory navigability or an acceptably efficient use of the tractive power required.

According to the present invention there is provided a flexible marine tank for transport afloat, comprising at least two flexible elements of revolution longitudinally connected by flexible linking means, and means for maintaining an internal pressurisation within the elements during the various phases of utilisation thereof in order to maintain the geometric shape of the elements.

The bi-lobed or multi-lobed structure of such a tank has satisfactory stability to rolling and for a given applied traction it has a minimum of drag while permitting accommodation of the disturbing forces caused by swell, and more particularly it tends to reduce the drag compared to what it would be for a similar sized tank of rigid geometry. The turning stability can be ensured by an underwater keel.

Since the containers in use are always under pressure the geometry of the assembly is, however, virtually maintained. The tank may be towed or it may be self-propelling. By virtue of its very constitution the tank may be stored when empty, deflated and folded to a minimum volume, which is advantageous for maintenance, shipment and eventual letting out at the location of utilisation.

Preferably the tank is provided with a settling arrangement which makes it possible to separate immiscible liquid phases of different densities during a filling operation. This feature is the more interesting since such separating means are useful for separating liquid having its origin in a pollution of water, especially by crude oil. This settling or separating arrangement also enables ballasting of the tank to be ensured, for example when it is to be floatingly conveyed in empty state, and facilitates post-utilisation cleaning operations by internal circulation of detergents.

The invention will be better understood when reading the following description of several exemplary embodiments referring to the accompanying drawings, in which:-

FIG. 1 is a plan view of a tank according to the invention;

FIGS. 1*a* and 2 are elevational views of the same tank in floating position;

Figure 1:
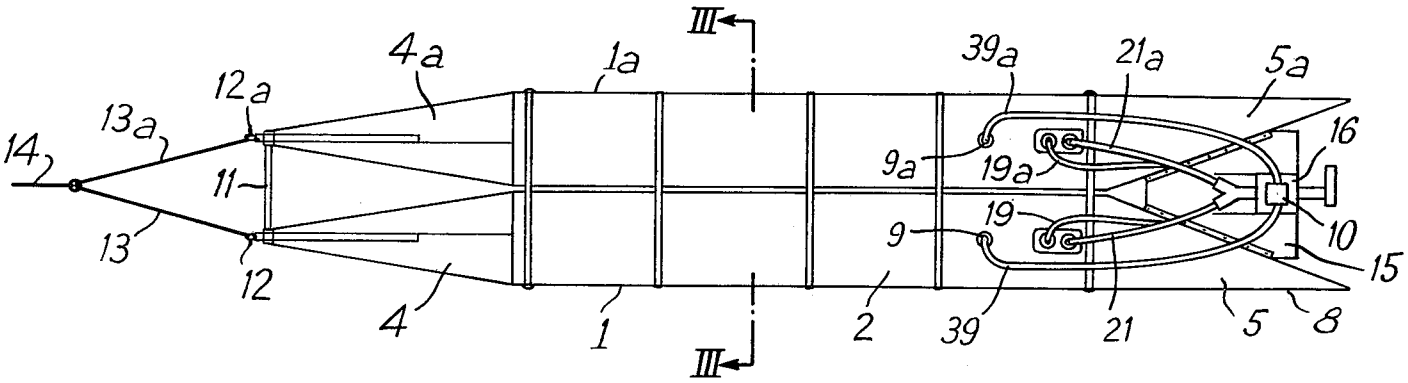
Figure 2:
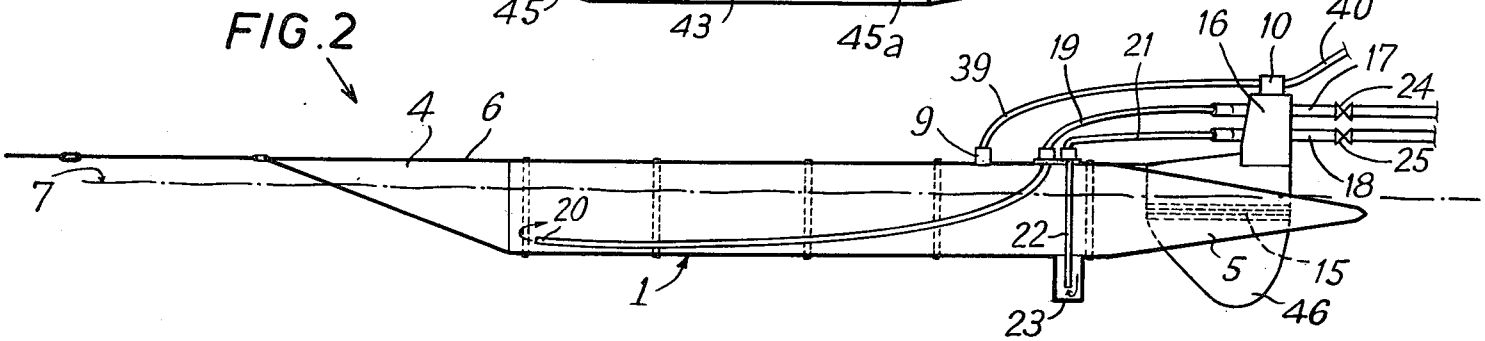
Figure 3:
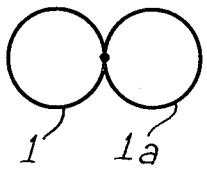
FIG. 3 is a view in section of the tank, taken along line III—III of FIG. 1.

FIGS. 1, 2 and 3 show a tank according to the invention which comprises two flexible elements of revolution 1 and 1*a* each of which consists of a cylindrical portion 2 extended at either end by conical portions 4 and 5. The fore and aft conical portions 4 and 5 will preferably be identical for reasons of ease of manufacture. However the conical portions 4 and 5 may be so arranged, as shown, that one of the generatrices 6 and 8 of each portion respectively is perpendicular to the circular base of the oblique cone. It is thus possible to assemble these conical portions to the cylindrical bodies 2 of the reservoirs in such manner that, both fore and aft, the conical end portions provide desirable dynamic effects when the apparatus is moved through the liquid medium.

More particularly, referring to the drawings, the planes of symmetry of the oblique cones 4 and 5 are vertical at the front and horizontal at the rear.

Figure 1A:
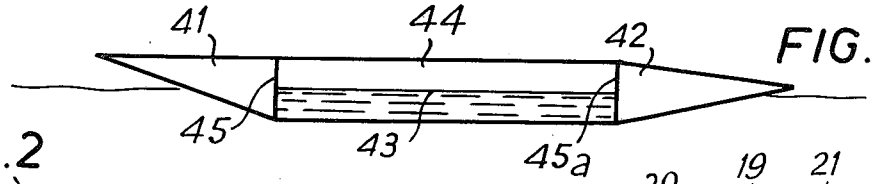

Each element 1, 1*a* of the tank is divided into three compartments 44, 41, 42 by watertight bulkheads 45, 45*a* (FIG. 1*a*) so as to create a longitudinal compartmenting which imparts to the tank good floatation stability to pitching when the tank is only partly filled with liquid.

The compartments 41 and 42 which may be limited to the conical portions 4 and 5 are inflated with a gas which represents a permanent buoyancy reserve, while the central compartment 44, which is also pressurised, is a reservoir intended to receive liquid 43 which may fill or partly fill the compartment 44 to any level as required without affecting to too large an extent the floatability stability to pitching.

The walls of the elements are made of a resilient material, for example a fabric coated with elastomer. The elements maintain their geometry by virtue of the internal pressurisation kept up during the various phases of utilisation.

To this end each element has an inflation orifice 9, 9*a* connected by a duct 39, 39*a* to a compressed air supply conduit 40. A calibrated pressure relief valve 10 is disposed on the conduit 40.

The conical portions 4, 4*a* situated at the front of the tank are linked by a rigid bar 11 and each comprise an eyelet 12, 12*a* in which a sling 13, 13*a* is engaged.

In the event of the tank being towed the slings 13, 13*a* are connected to a traction cable 14.

At the rear of the tank there is provided a deck 15 capable of receiving a propulsion motor assembly, a pumping motor assembly for filling and emptying the tank and a compression motor assembly for maintaining the pressurisation. None of these assemblies is shown in the drawings.

The stern deck 15 may also form a support element when the tank is being pushed rather than towed.

Furthermore, this deck carries a support 16 to which the filling lines 17 and emptying lines 18 and an underwater keel 46 are secured.

The filling line 17 is connected to two ducts 19, 19a directly opening via an orifice 20 into the flexible elements 1, 1*a*. The discharge line 18 on the other hand is connected to two ducts 21, 21*a* which are extended by a dip pipe 22 opening at its lower portion into a sump 23 adapted to the lower portion of each flexible element 1, 1*a* and capable of forming a bilge-keel for stabilising the assembly.

For conveying in empty state the elements 1, 1*a* of the tank are inflated with air although in the event of strong winds they may be ballasted with water in order that the tank will float lower in the water.

Furthermore, there is provided in the filling line at least one closure valve 24 and in the emptying line 18 at least one closure valve 25 (FIGS. 1 and 2).

For filling the tank with a liquid, for example crude oil or a mixture of water and crude oil, the valve 24 is open so as to permit the entry via the ducts 19, 19*a* of the liquid.

The air expelled by the arrival of the liquid escapes via the excess pressure valve 10.

Where a mixture is admitted the valve 25 can be opened to allow the lower layer of water which settles to the bottom of the tank beneath the oil to escape under the effect of the pressurisation via the dip pipes 22; which makes it possible to evacuate the water to the exterior via the line 18. At the end of filling when the crude oil begins to be discharged via the line 18 the valve 25 is closed.

For emptying the tank the valve 24 is closed and the valve 25 is opened, the crude oil is pumped via the tubing 18, the sump 23 and the dip pipe 22, the provision of the sump reducing to a minimum the amount of liquid left in the tank.

The shape and the buoyancy of the tank are maintained by feeding air into the elements by means of the orifice 9 at the same time as the liquid is removed.

Figure 4:
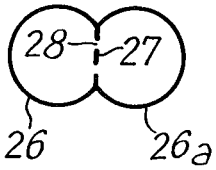
FIG. 4 is a view similar to FIG. 3 of an alternative form of tank the flexible elements of which communicate with one another.

FIG. 4 shows a further embodiment of the tank wherein the flexible elements 26, 26*a* are interconnected by a wall 27 having orifices 28 which permit communication between the two enclosures.

Figure 5:
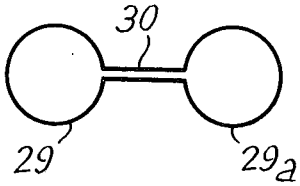
FIG. 5 is a view in section similar to FIG. 3 of an alternative form of tank the separate flexible elements of which are linked by an intermediate member.

Finally, according to a further embodiment shown in FIG. 5 the tank comprises two flexible elements 29, 29*a* which are linked by at least one intermediate member 30 which may be rigid.

Figure 7:
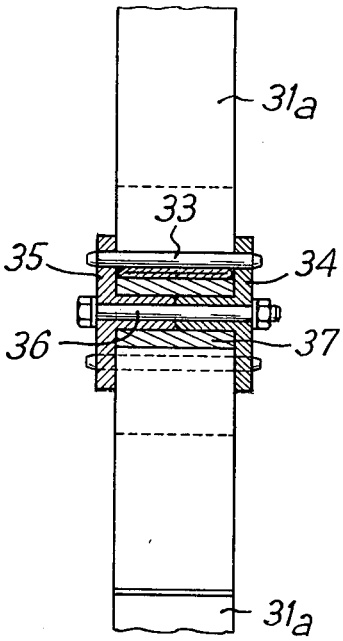
FIG. 7 is a view in section taken along line VII—VII of FIG. 6.
Figure 6:
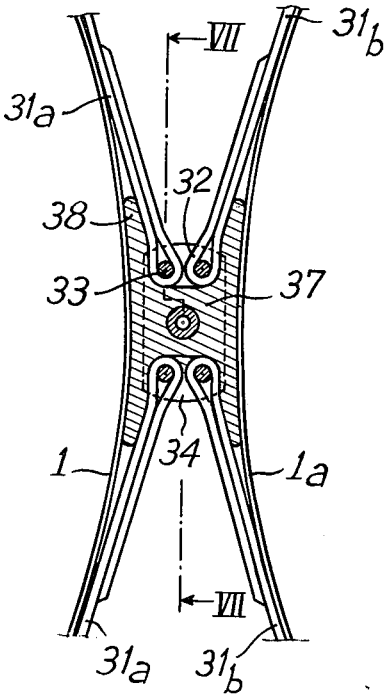
FIG. 6 is a sectional detail view showing a flexible mode of linking a pair of coupled flexible elements.

In FIGS. 6 and 7 there is shown a special mode of linking the two elements 1, 1*a* of the tank when they are coupled as in FIGS. 1, 2 and 3.

For this purpose hoops 31*a* and *b* are respectively attached to the elements 1, 1*a* and have loops 32 in which are engaged rods 33 integral with the hoops and engaged in plates 34, 35 held together by a bolt 36; the said plates being separated by an elastic sleeve 37 having fins 38 disposed between the elements 1, 1*a* and the hoops 31*a*, 31*b*.

A plurality of these linking assemblies are distributed along the length of the tank.

Although only two flexible elements have been shown to form the tank, it is evident that a much larger number of elements may be used.

I claim:

1. A floating flexible marine transport tank assembly having means for loading and unloading liquid cargo comprising at least two flexible elements of revolution longitudinally and transversely connected by flexible harnesses prestressed by the pressurizing of said flexible elements, said flexible elements maintaining their geometry to internal pressurization thereof.

2. A marine tank according to claim 1, wherein each element is formed of a cylindrical portion and two oblique conical portions one at each end of the said element, each conical portion having at one side a generatrix perpendicular to the base of the conical portion and situated as a continuation of the cylindrical portion.

3. A marine tank according to claim 1, wherein each element comprises two watertight bulkheads dividing it into at least three compartments arranged in series, the central compartment representing a reservoir for liquid and the two end compartments being inflated by a gas.

4. A marine tank according to claim 1, wherein at one end of the tank there are provided a rigid linking member connecting the ends of the elements and traction members individual to the said element secured thereto, the tank being towable by attaching a cable to the traction members.

5. A marine tank according to claim 1, having conical portions at the stern end of each element, there being provided a deck between said stern end conical portions adapted to retain apparatus for pumping, pressurising, and propelling the tank.

6. A marine tank according to claim 5, including means for allowing the tank to be pushed by a boat from its stern deck.

7. A marine tank according to claim 1, wherein there is provided for each element of the tank at least one intake duct and one liquid outlet duct connected to the said element, each element having a sump extending at the lower portion thereof in the form of a bilge-keel for stabilising the tank and the outlet duct having an exterior dip pipe opening into said sump.

8. A marine tank according to claim 1, wherein each element is provided with at least one inflation orifice and a duct connected to said orifice, the tank including a pressure supply conduit connected to said duct and provided with a pressure relief valve.

9. A marine tank according to claim 1, wherein the flexible elements are coupled together as separate containers.

10. A flexible marine tank for transport afloat, comprising at least two elongated flexible elements of revolution, flexible linking means connecting the said elements in side by side relationship, and means for internally pressurizing said elements to maintain the geometric shape thereof, said linking means comprising hoops secured about the elements, shafts carried by said hoops, two plates secured to said shafts and a resilient sleeve separating the two plates, said sleeve having fins extending between the elements and the hoops.

11. A marine tank according to claim 1, wherein an underwater keel is provided at the stern of the tank to contribute to the turning stability of the tank while being towed.

12. A flexible marine tank assembly for transport afloat comprising at least two substantially cylindrical elongated flexible elements of revolution whose structural rigidity and geometrical shape are maintained by pressurization of the interior thereof, means for internally pressurizing said elements, and semi-resilient linking means connecting said elements in side-by-side relationship for restraining lateral, longitudinal and up and down relative movement between said elements while allowing limited pivotal movement of said elements about said linking means, said linking means having a resilient sleeve disposed between and separating the elements, the linked elements being rollable as a unit in response to undulations of the marine surface and being towable as a unit.

* * * * *